US005958640A

United States Patent [19]

Hasegawa et al.

[11] Patent Number: 5,958,640

[45] Date of Patent: Sep. 28, 1999

[54] POLYMERIZED TONER AND PRODUCTION PROCESS THEREOF

[75] Inventors: Jun Hasegawa, Tokyo; Tokudai Ogawa, Kanagawa; Jun Sakai, Kanagawa; Takahiro Takasaki, Kanagawa; Noboru Yanagida, Kanagawa, all of Japan

[73] Assignee: Nippon Zeon Company, Ltd, Tokyo, Japan

[21] Appl. No.: 08/949,432

[22] Filed: Oct. 14, 1997

[30] Foreign Application Priority Data

Oct. 14, 1996 [JP] Japan ..... 8-291146

[51] Int. Cl.[6] ..... G03G 9/093

[52] U.S. Cl. ..... 430/109; 430/111; 430/138; 399/252

[58] Field of Search ..... 430/109, 111, 430/138

[56] References Cited

U.S. PATENT DOCUMENTS

| | | | |
|---|---|---|---|
| 5,288,577 | 2/1994 | Yamaguchi et al. | 430/111 |
| 5,618,647 | 4/1997 | Kukimoto et al. | 430/106.6 |
| 5,733,235 | 3/1998 | Waku et al. | 492/25 |
| 5,753,396 | 5/1998 | Nakamura et al. | 430/111 |

FOREIGN PATENT DOCUMENTS

| | | |
|---|---|---|
| 0 261 686 | 3/1988 | European Pat. Off. . |
| 0 615 167 | 9/1994 | European Pat. Off. . |
| 0 725 317 | 8/1996 | European Pat. Off. . |
| 32 28 543 | 2/1983 | Germany . |
| 57-45558 | 3/1982 | Japan . |
| 60-173552 | 9/1985 | Japan . |
| 61-118758 | 6/1986 | Japan . |
| 2-259657 | 10/1990 | Japan . |
| 3-136065 | 6/1991 | Japan . |
| 3-203746 | 9/1991 | Japan . |
| WO 94 20585 | 9/1994 | WIPO . |

*Primary Examiner*—Roland Martin

*Attorney, Agent, or Firm*—Armstrong, Westerman, Hattori, McLeland & Naughton

[57] ABSTRACT

Disclosed herein are a polymerized toner of core-shell structure, comprising core particles composed of colored polymer particles having a volume average particle diameter (dv) of 0.5–20 $\mu$m and a ratio (dv/dp) of the volume average particle diameter (dv) to a number average particle diameter (dp) of at most 1.7, and shell which is formed of a polymer layer having an average film thickness of 0.001–0.1 $\mu$m and covers each of the core particles, and a production process thereof.

9 Claims, 1 Drawing Sheet

POLYMERIZED TONER AND PRODUCTION PROCESS THEREOF

FIELD OF THE INVENTION

The present invention relates to a polymerized toner and a production process thereof, and more particularly to a polymerized toner suitable for use in developing an electrostatic latent image formed by an electrophotographic process, electrostatic recording process or the like, and a production process thereof. The present invention also relates to an image forming process making use of such a polymerized toner, and an image forming apparatus containing said polymerized toner.

BACKGROUND OF THE INVENTION

In the electrophotographic process or electrostatic recording process, two-component developers composed of a toner and carrier particles, and one-component developers composed substantially of a toner alone and making no use of any carrier particles are known as developers for making an electrostatic latent image visible. The one-component developers include magnetic one-component developers containing magnetic powder, and non-magnetic one-component developers containing no magnetic powder. In the non-magnetic one-component developers, a flowability improver such as colloidal silica is often added independently in order to enhance the flowability of the toner. As the toner, there are generally used colored particles obtained by dispersing a colorant such as carbon black and other additives in a binder resin and granulating the dispersion.

Production processes of a toner are roughly divided into a grinding process and a polymerization process. In the grinding process, a thermoplastic resin, a colorant and optional other additives are melted and mixed, the mixture is ground, and the ground product is then classified so as to obtain particles having a desired particle diameter, thereby obtaining a toner. In the polymerization process, a polymerizable monomer composition is prepared by uniformly dissolving or dispersing a colorant, a polymerization initiator and optional various additives such as a crosslinking agent and a charge control agent in a polymerizable monomer, the polymerizable composition is then dispersed in an aqueous dispersion medium containing a dispersion stabilizer by means of a stirrer to form minute droplets of the polymerizable monomer composition, and the dispersion containing the minute droplets are then heated to subject the droplets to suspension polymerization, thereby obtaining a toner (polymerized toner) having a desired particle diameter.

Even when each of these developers is used, an electrostatic latent image is developed with the toner. In general, in an image forming apparatus such as an electrophotographic apparatus or electrostatic recording apparatus, an electrostatic latent image is formed on a photosensitive member evenly charged by exposure to a light pattern, and a toner is applied to the electrostatic latent image to form a toner image (make the latent image visible). The toner image is transferred to a transfer medium such as transfer paper, and the unfixed toner image is then fixed to the transfer medium by a method such as heating, pressing or use of solvent vapor. In the fixing step, the toner is often fusion-bonded to the transfer medium by passing the transfer medium, to which the toner image has been transferred, through between a heating roll (fixing roll) and a press roll to press-bond the toner under heat.

Images formed by an image forming apparatus such as an electrophotographic copying machine are required to improve their definition year by year. As a toner used in the image forming apparatus, a toner obtained by the grinding process has heretofore been mainly used. According to the grinding process, colored particles having a wide particle diameter distribution are liable to be formed. In order for the toner to exhibit satisfactory developing characteristics, therefore, the ground product must be classified to adjust the toner to a limited particle diameter distribution to some extent. However, the classification itself is complicated, and its yield is poor, and so the percent yield of the toner is reduced to a great extent. Whereas, the polymerized toner is easy to control its particle diameter without conducting complicated production steps such as classification and it has come to attract attention in recent years. According to the suspension polymerization process, a polymerized toner having a desired particle diameter and a particle diameter distribution can be obtained without need of grinding and classification. However, the conventional polymerized toners have involved a problem that they can not fully meet requirements in recent years, such as high-speed copying, formation of full-color images and energy saving.

In recent years, copying machines or printers of an electrophotographic system have been required to permit not only reduction of demand power, but also high-speed copying or high-speed printing. A step in which energy is particularly demanded in the electrophotographic system is a fixing step conducted after transferring a toner from a photosensitive member to a transfer medium such as transfer paper. In the fixing step, the toner is fixed to the transfer medium by heating and melting it. Therefore, a heating roll heated to a temperature of at least 150° C. is used, and electric power is used as an energy source therefor. There is a demand for lowering the temperature of the heating roll from the viewpoint of energy saving. In order to lower the temperature of the heating roll, it is necessary to make the toner possible to fix at a temperature lower than that heretofore used. Namely, it is necessary to lower the fixing temperature of the toner itself. The use of a toner capable of fixing at a temperature lower than that heretofore used permits lowering the temperature of the heating roll, and on the other hand shortening the fixing time if the temperature of the heating roll is not very lowered. Therefore, such a toner can meet high-speed copying and high-speed printing.

In order to meet requirements of energy saving, high-speed copying and the like from the image forming apparatus in the design of a toner, it is only necessary to lower a glass transition temperature of a binder resin making up the toner. When a toner is made up of a binder resin having a low glass transition temperature, however, the toner becomes poor in the so-called shelf stability because particles themselves of the toner tend to undergo blocking during storage or shipment, or in a toner box of an image forming apparatus, to aggregate.

In recent years, it has been desired to permit formation of bright images in color copying or color printing by the electrophotographic system. For example, in the full-color copying, the mere melting and softening of toners in a fixing step to fusion-bond the toners to a transfer medium are not enough, but it is also necessary to uniformly melt and mix the toner of different colors to mix their colors. In particular, since color images have come to be often used in OHP (overhead projector) sheets for presentations in various meetings or conferences, toner images fixed to such OHP sheets have been required to have excellent permeability through OHP. In order to meet the excellent permeability through OHP, it is necessary for the toners to uniformly melt on a transparent OHP sheet made of a synthetic resin.

Therefore, the melt viscosity of each toner at about the fixing temperature thereof must be designed low compared with the conventional toners. Means for lowering the melt viscosity of the toner include a method in which the molecular weight or glass transition temperature of a binder resin used is lowered compared with the binder resins for the conventional toners. In any of these methods, however, the toner becomes poor in shelf stability because the toner tends to undergo blocking.

As a method for obtaining a polymerized toner having excellent fixing ability, it has heretofore been proposed in, for example, Japanese Patent Application Laid-Open No. 136065/1991 to subject a polymerizable monomer containing a colorant and a charge control agent to suspension polymerization in the presence of a macromonomer. The macromonomer is a relatively long-chain linear molecule having a polymerizable functional group, for example, a group containing an unsaturated bond such as a carbon-carbon double bond, at its molecular chain terminal. According to this method, the macromonomer is incorporated as a monomer unit into the molecular chain of a polymer formed. Therefore, many branches attributable to the long-chain linear molecule of the macromonomer are generated in the molecular chain of the polymer. The polymer apparently becomes a high molecular weight polymer due to entanglement of the branches, i.e., the so-called physical crosslinking, so that the offset resistance of the toner is improved. On the other hand, the physical crosslinking by the macromonomer component is different from chemical crosslinking using a crosslinking monomer such as divinylbenzene and is of a loose crosslinked structure, and so the crosslinked structure is easy to be broken by heating. Accordingly, this polymerized toner is easily melted upon fixing using a heating roll and hence has excellent fixing ability. However, the polymerized toner tends to undergo aggregation among toner particles during storage, and is hence unsatisfactory from the viewpoint of shelf stability.

According to the conventional methods for lowering the fixing temperature of a toner and improving the uniformly melting ability thereof, as described above, an adverse correlation that the fixing ability of the resulting toner is improved, but its shelf stability is lowered arises. As a means for solving this adverse correlation, there has been proposed the so-called capsule type toner in which a toner made up of a binder resin having a low glass transition temperature is covered with a polymer having a high glass transition temperature, thereby improving the blocking resistance of the toner to solve the problem of shelf stability.

As a production process of the capsule type toner, for example, Japanese Patent Application Laid-Open No. 173552/1985 has proposed a process in which a coating layer composed of a colorant, magnetic particles or a conductive agent and a binder resin is formed on the surfaces of core particles having a minute particle size by means of a jet mill. As the core particles, there are used particles formed of a thermoplastic transparent resin such as an acrylate resin or styrenic resin. In this publication, it has been reported that according to this process, a toner of multi-layer structure, which has excellent flowability and improved functional characteristics, can be obtained. When core particles having a low glass transition temperature are used in this method, however, the core particles themselves tend to undergo aggregation. In addition, according to this method, the coating thickness of the binder resin is liable to thicken. Accordingly, this method is difficult to provide a toner improved in both fixing ability and uniformly melting ability while retaining its shelf stability.

Japanese Patent Application Laid-Open No. 259657/1990 has proposed a process for producing a toner for electrophotography, in which crosslinked toner particles prepared by suspension polymerization are added to a solution with an encapsulating polymer, a charge control agent and a parting agent dissolved in an organic solvent, and a poor solvent is then added to the resultant mixture to form a coating film of the encapsulating polymer containing the charge control agent and the parting agent on surfaces of the crosslinked toner particles. According to this process, however, it is difficult to obtain spherical particles because the solubility of the encapsulating polymer is reduced by the addition of the poor solvent to deposit it on the surfaces of the crosslinked toner particles. The capsule wall formed on the surface of the crosslinked toner particle according to this process is uneven in thickness, and moreover is relatively thick. As a result, the effects of improving development properties and fixing ability become insufficient.

Japanese Patent Application Laid-Open No. 45558/1982 has proposed a process for producing a toner for developing electrostatic latent images, in which core particles formed by polymerization are mixed and dispersed in a 1–40 wt. % aqueous latex solution, and a water-soluble inorganic salt is then added to the dispersion to form a coating layer formed of fine particles obtained by emulsion polymerization on surfaces of the core particles. However, this process has involved a drawback that the temperature dependence of charge properties of the resultant toner becomes great due to the influence of the surfactant and inorganic salt remaining on the fine particles, and in particular, the charge properties are deteriorated under high-temperature and high-humidity conditions.

Japanese Patent Application Laid-Open No. 118758/1986 discloses a process for producing a toner, in which a composition containing a vinyl monomer, a polymerization initiator and a colorant is subjected to suspension polymerization to obtain core particles, and another vinyl monomer capable of providing a polymer having hydrophilicity at least equal to that of the resin contained in the core particles and a glass transition temperature higher than that of said resin is polymerized in the presence of the core particles to form shell on each of the core particles. According to this process, the vinyl monomer for forming the shell is adsorbed on the core particles to grow them, so that in many cases, it may be difficult to create a clear core-shell structure because the vinyl monomer absorbed in the interior of the core particles is polymerized. Accordingly, this process is difficult to provide a toner sufficiently improved in shelf stability. In addition, in order to create a clear core-shell structure so as to improve the shelf stability, it is necessary to thicken the thickness of the shell.

OBJECTS AND SUMMARY OF THE INVENTION

It is an object of the present invention to provide a polymerized toner having a low fixing temperature and uniformly melting ability, and moreover excellent shelf stability (blocking resistance), and a production process thereof.

Another object of the present invention is to provide a polymerized toner which can meet high-speed and full-color copying and printing, and energy saving, and a production process thereof.

A further object of the present invention is to provide a polymerized toner capable of forming a toner image which exhibit excellent permeability (permeability through OHP)

when conducting printing on an OHP sheet with the toner and fixing thereto, and a production process thereof.

A still further object of the present invention is to provide an image forming process making use of the polymerized toner having such excellent various properties, and an image forming apparatus in which said polymerized toner is contained.

The present inventors have carried out an extensive investigation with a view toward overcoming the above-mentioned problems involved in the prior art. As a result, it has been found that a polymerized toner of core-shell structure, which is excellent in the above-described various properties, can be obtained by subjecting a composition containing a colorant and a polymerizable monomer capable of forming a polymer having a glass transition temperature of not higher than 70° C. to suspension polymerization in the presence of a macromonomer to prepare colored polymer particles, and then using the colored polymer particles as core particles to subject another polymerizable monomer capable of forming a polymer having a glass transition temperature higher than that of the polymer component making up the core particles to suspension polymerization in the presence of the core particles, thereby forming shell which is formed of a polymer layer and covers each of the core particles.

According to the polymerized toner of the present invention, the core particles containing the polymer component lower in glass transition temperature permit lowering the fixing temperature, also improving the uniformly melting ability and further meeting requirements such as high-speed and full-color copying and printing, and permeability through OHP. In addition, according to the polymerized toner of the present invention, the core particles can be covered with an extremely thin shell, so that the toner can not only exhibit good shelf stability (blocking resistance), but also fully meet various requirements such as fixing ability and uniformly melting ability.

The present invention has been led to completion on the basis of these findings.

According to the present invention, there is thus provided a polymerized toner of core-shell structure, comprising core particles composed of colored polymer particles having a volume average particle diameter (dv) of 0.5–20 μm and a ratio (dv/dp) of the volume average particle diameter (dv) to a number average particle diameter (dp) of at most 1.7, and shell which is formed of a polymer layer having an average film thickness of 0.001–0.1 μm and covers each of the core particles.

According to the present invention, there is also provided a process for producing a polymerized toner of core-shell structure, which comprises the steps of:

(1) subjecting a polymerizable monomer composition containing at least a colorant and a polymerizable monomer for core, which is capable of forming a polymer having a glass transition temperature of not higher than 70° C., to suspension polymerization in the presence of a macromonomer in an aqueous dispersion medium containing a dispersing agent to prepare core particles formed of colored polymer particles; and then (2) subjecting a polymerizable monomer for shell, which is capable of forming a polymer having a glass transition temperature higher than that of the polymer component making up the core particles, to suspension polymerization in the presence of the core particles, thereby forming shell which is formed of a polymer layer and covers each of the core particles.

According to the present invention, there is further provided an image forming process, comprising the steps of applying a toner to the surface of a photosensitive member, on which an electrostatic latent image has been formed, to make the latent image visible, and then transferring the visible image to a transfer medium, wherein the above-described polymerized toner of core-shell structure is used as the toner.

According to the present invention, there is still further provided an image forming apparatus, comprising a photosensitive member, a means for charging the surface of the photosensitive member, a means for forming an electrostatic latent image on the surface of the photosensitive member, a means for receiving a toner, a means for supplying the toner to develop the electrostatic latent image on the surface of the photosensitive member, thereby forming a toner image, and a means for transferring the toner image from the surface of the photosensitive member to a transfer medium, wherein the means for receiving the toner contains the above-described polymerized toner of core-shell structure.

DETAILED DESCRIPTION OF PREFERRED EMBODIMENTS

Figure 1:
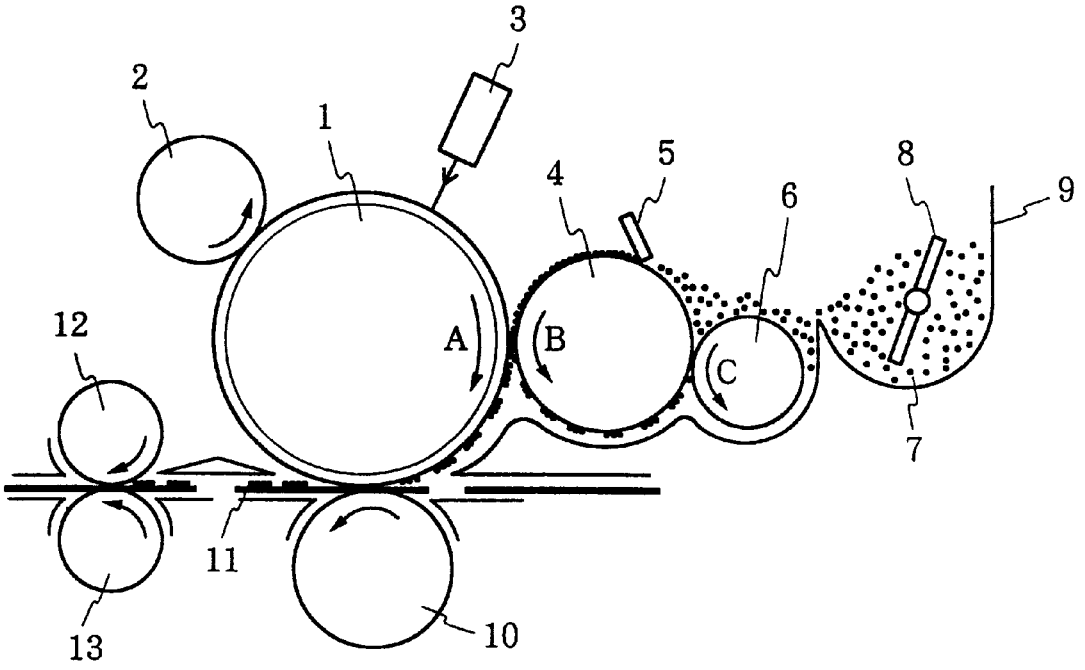
FIG. 1 is a cross-sectional view illustrating an example of an image forming apparatus to which a polymerized toner according to the present invention is applied.

The polymerized toner according to the present invention has a core-shell structure comprising core particles and shell which covers each of the core particles.

In the polymerized toner according to the present invention, the volume average particle diameter (dv) of the core particles is within a range of 0.5–20 μm, preferably 1–10 μm. If the core particles are too great, the resolution of an image formed with such toner tends to lower. The ratio (dv)/(dp) of the volume average particle diameter (dv) to a number average particle diameter (dp) in the core particles is at most 1.7, preferably at most 1.5. If this ratio exceeds 1.7, the resolution of an image formed with such toner tends to lower. In the polymerized toner according to the present invention, the average film thickness of the shell is within a range of 0.001–0.1 μm, preferably 0.05–0.07 μm, more preferably 0.005–0.05 ρm. If the thickness of the shell is too great, the fixing ability of the resulting toner is deteriorated. If the thickness is too small on the other hand, the shelf stability of the resulting toner is deteriorated.

The particle diameters of the core particles and the thickness of the shell in the polymerized toner of core-shell structure can be determined by directly measuring the sizes and shell thickness of particles selected at random from an electron photomicrography when they can be observed through an electron microscope. If it is difficult to observe the particle diameters of the core particles and the thickness of the shell through the electron microscope, the particle diameters of the core particles are measured through the electron microscope in the same manner as described above or by means of a Coulter counter at the stage of formation of the core particles. After each of the core particles is then covered with the shell, the particle diameters of the resultant polymerized toner particles are measured through the electron microscope or by means of the Coulter counter, whereby the average thickness of the shell can be determined by changes in particle diameter before and after the covering with the shell. When these methods are difficult to use, the average particle diameter of the core particles and the average film thickness of the shell can be calculated out from the used amount of the polymerizable monomer for forming the core particles and the used amount of the polymerizable monomer for forming the shell.

The polymerized toner according to the present invention contains toluene-insoluble matter in an amount of generally at most 50 wt. %, preferably at most 40 wt. %, more preferably at most 30 wt. %. If the toluene-insoluble matter is contained in plenty, the fixing ability of the resulting polymerized toner tends to lower, The toluene-insoluble matter is determined by placing a polymer component making up the polymerized toner in a 80-mesh woven metal basket, immersing the basket in toluene for 24 hours at room temperature and then measuring the weight of solids remaining in the basket to express it in terms of percent by weight (wt. %) based on the weight of the polymer component.

The polymerized toner according to the present invention has a ratio (rl/rs) of the length (rl) to the breadth (rs) within a range of 1–1.2, preferably 1–1.15.

If the ratio is too high, the resolution of an image formed from such a polymerized toner is deteriorated. In addition, when such a polymerized toner is contained in a toner container in an image forming apparatus, its durability shows a tendency to lower because friction between particles of the polymerized toner becomes greater, and so additives such as a flowability improver are separated from the toner.

On the polymerized toner according to the present invention, in general, a peak I appears between 0 and 80° C., and a peak II appears within a temperature range higher than that corresponding to the peak I by the first scanning in an analysis by means of a differential scanning calorimeter (DSC). A peak appears between 0 and 90° C. by the second scanning, but no peak appears within a temperature range higher than that corresponding to such a peak. A difference between temperatures corresponding to the peaks I and II is generally at least 20° C. Any polymerized toner on which two peaks appear as described above is well balanced between shelf stability and fixing ability.

The polymerized toner according to the present invention can be produced by subjecting a polymerizable monomer composition containing at least a colorant and a polymerizable monomer for core, which is capable of forming a polymer having a glass transition temperature of not higher than 70° C., to suspension polymerization in the presence of a macromonomer in an aqueous dispersion medium containing a dispersing agent to prepare core particles formed of colored polymer particles [Step (1)], and then subjecting a polymerizable monomer for shell, which is capable of forming a polymer having a glass transition temperature higher than that of the polymer component making up the core particles, to suspension polymerization in the presence of the core particles, thereby forming shell which is formed of a polymer layer and covers each of the core particles [Step (2)].

The polymerizable monomer for core useful in the practice of the present invention is such that can form a polymer having a glass transition temperature of not higher than 70° C., preferably 10–60° C., more preferably 15–50° C. As the polymerizable monomer for core, there may be used a kind of such monomer or any combination of such monomers. If the polymerizable monomer for core is such that can form a polymer having a glass transition temperature higher than 70° C., the resulting polymerized toner has a higher fixing temperature and deteriorated permeability through OHP and can not meet high-speed copying and printing.

The glass transition temperature (Tg) of a polymer is a calculated value (referred to as calculated Tg) calculated out according to the kind(s) and proportion(s) of monomer(s) used. When the monomer used is one, the Tg of a homopolymer formed from this monomer is defined as Tg of the polymer in the present invention. For example, the Tg of polystyrene is 100° C. Therefore, when styrene is used as a monomer by itself, the monomer is said to form a polymer having a Tg of 100° C. When monomers used are two or more, and the polymer formed is a copolymer, the Tg of the copolymer is calculated out according to the kinds and proportions of the monomers used. For example, when 70 wt. % of styrene and 30 wt. % of n-butyl acrylate are used as monomers, the monomers are said to form a polymer having a Tg of 35° C. because the Tg of a styrene-n-butyl acrylate copolymer formed at this monomer ratio is 35° C.

The definition of "a polymerizable monomer for core, which is capable of forming a polymer having a glass transition temperature of not higher than 70° C." does not mean that when plural monomers are used, the individual monomers must form a polymer having a Tg of not higher than 70° C. When one monomer is used, the Tg of a homopolymer formed from the monomer must be not higher than 70° C. When two or more monomers are used, however, it is only necessary for the Tg of a copolymer formed from the monomer mixture to be not higher than 70° C. Therefore, those which separately form a homopolymer having a Tg higher than 70° C. may be contained in the monomer mixture. For example, although the Tg of a styrene homopolymer is 100° C., styrene may be used as a component of the polymerizable monomer for core so far as a copolymer having a Tg of not higher than 70° C. can be formed by using a mixture of styrene with a monomer (for example, n-butyl acrylate) which forms a homopolymer having a low Tg.

In the present invention, vinyl monomers are generally used as the polymerizable monomer for core. Various kinds of vinyl monomers are used either singly or in any combination thereof to adjust in such a manner that the resulting polymer will have a Tg within the desired range.

Examples of the vinyl monomers used in the present invention include styrenic monomers such as styrene, vinyltoluene and α-methylstyrene; acrylic acid and methacrylic acid; (meth)acrylic acid derivatives such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monomers may be used either singly or in any combination thereof.

Of these, combinations of a styrenic monomer with a (meth)acrylic acid derivative may preferably be used. Preferable specific examples thereof include combinations of styrene with butyl acrylate (i.e., n-butyl acrylate), and styrene with 2-ethylhexyl acrylate.

It is preferable from the viewpoint of improvement in the shelf stability of the resulting polymerized toner to use a crosslinking monomer as a polymerizable monomer for core in addition to these vinyl monomers. Examples of the crosslinking monomer include aromatic divinyl compounds such as divinylbenzene, divinylnaphthalene and derivatives thereof; diethylenic esters of unsaturated carboxylic acids such as ethylene glycol dimethacrylate and diethylene glycol dimethacrylate; divinyl compounds such as N,N-divinylaniline and divinyl ether; and compounds having at least three vinyl groups. These crosslinking monomers may be used either singly or in any combination thereof. In the present invention, the crosslinking monomer is desirably used in a proportion of generally 0.01–5 parts by weight, preferably 0.05–2 parts by weight per 100 parts by weight of the polymerizable monomer for core.

The macromonomer (also referred to as macromer) useful in the practice of the present invention is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of generally 1,000–30,000. If a macromonomer having a too low number average molecular weight is used, the surface part of the resulting polymerized toner becomes soft, and its shelf stability shows a tendency to deteriorate. If a macromonomer having a too high number average molecular weight is used on the other hand, the flowability of the macromonomer becomes poor, resulting in a polymerized toner deteriorated in fixing ability and shelf stability.

Examples of the polymerizable vinyl functional group which the macromonomer has at its molecular chain terminal include an acryloyl group and a methacryloyl group, with the methacryloyl group being preferred from the viewpoint of easy copolymerization.

The macromonomer used in the present invention preferably has a glass transition temperature higher than that of the polymer obtained by polymerizing the polymerizable monomer for core. A difference in Tg between the polymer obtained by polymerizing the polymerizable monomer for core and the macromonomer may be relative. For example, when the polymerizable monomer for core is such that forms a polymer having a Tg of 70° C., it is only necessary for the macromonomer to have a Tg higher than 70° C. When the polymerizable monomer for core is such that forms a polymer having a Tg of 20° C., the macromonomer may also be that having a Tg of, for example, 60° C. The Tg of the macromonomer is a value measured by means of an ordinary measuring device such as an DSC.

Examples of the macromonomer used in the present invention include polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7. Of these macromonomers, those having hydrophilicity, in particular, polymers obtained by polymerizing methacrylic esters or acrylic esters either singly or in combination of two or more monomers thereof are preferred in the present invention.

The amount of the macromonomer used is generally 0.01–10 parts by weight, preferably 0.03–5 parts by weight, more preferably 0.05–1 part by weight per 100 parts by weight of the polymerizable monomer for core. If the amount of the macromonomer used is too little, it is difficult to provide a polymerized toner well balanced between shelf stability and fixing ability.

In the present invention, the core particles are prepared by subjecting the polymerizable monomer for core, the macromonomer and optionally the crosslinking monomer to suspension polymerization.

The suspension polymerization is performed in an aqueous dispersion medium containing a dispersing agent. More specifically, the suspension polymerization is generally conducted by mixing a colorant, a polymerizable monomer for core, a macromonomer, a radical polymerization initiator, and optionally a crosslinking monomer and other additives, uniformly dispersing them by means of a ball mill or the like to prepare a liquid mixture, pouring the liquid mixture into an aqueous dispersion medium containing a dispersing agent, dispersing the liquid mixture in the dispersion medium by means of a mixer having high shearing force to form minute droplets, and then subjecting them to suspension polymerization at a temperature of 30–200° C.

The dispersing agent suitably used in the present invention is colloid of a hardly water-soluble metallic compound. Examples of the hardly water-soluble metallic compound include sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Of these, colloids of hardly water-soluble metal hydroxides are preferred because the particle diameter distribution of the resulting polymer particles can be narrowed, and the brightness of an image formed from such a polymerized toner is enhanced. In particular, when the crosslinking monomer is not copolymerized, the use of colloid of a hardly water-soluble metal hydroxide as the dispersing agent permits the provision of a polymerized toner improved in fixing ability and shelf stability.

The colloid of the hardly water-soluble metal hydroxide is not limited by the production process thereof. However, colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase is preferred.

The colloid of the hardly water-soluble metal hydroxide used in the present invention preferably has a number particle diameter distribution $D_{50}$ (50% cumulative value of number particle diameter distribution) of at most 0.5 $\mu$m and Dgo (90% cumulative value of number particle diameter distribution) of at most 1 $\mu$m. If the particle diameter of the colloid is too great, the stability of the suspension polymerization is broken.

The dispersing agent is generally used in a proportion of 0.1–20 parts by weight per 100 parts by weight of the polymerizable monomer for core. If the amount of the dispersing agent used is too small, it is difficult to achieve sufficient polymerization stability, so that aggregate of the resulting polymer tend to be formed. If the amount of the dispersing agent used is too great on the other hand, the viscosity of the aqueous dispersion medium becomes too high, resulting in a failure to form fine droplets. It is hence not preferable to use the dispersing agent in such a too small or great amount.

In the present invention, a water-soluble polymer may be used as a dispersing agent as needed. Examples of the water-soluble polymer include polyvinyl alcohol, methyl cellulose and gelatin. In the present invention, there is no need to use any surfactant. However, a small amount of a surfactant may be used for the purpose of stably conducting the suspension polymerization so far as dependence of the charge properties of the resulting polymerized toner on environment does not become large.

Examples of the radical polymerization initiator include persulfates such as potassium persulfate and ammonium persulfate; azo compounds such as 4,4-azobis(4-cyanovaleric acid), dimethyl 2,2'-azobis(2-methylpropionate), 2,2-azobis(2-amidinopropane) bihydrochloride, 2,2-azobis-2-methyl-N-1,1-bis (hydroxymethyl)-2-hydroxyethylpropionamide, 2,2'-azobis-(2,4-dimethylvaleronitrile), 2,2'-azobisisobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate.

Of these radical polymerization initiators, oil-soluble radical initiators are preferred, with oil-soluble radical initiators selected from among organic peroxides whose ten-hour half-life temperatures are 60–80° C., preferably 65–80° C. and whose molecular weights are 250 or lower being particularly preferred. Of the oil-soluble radical initiators, t-butyl peroxy-2-ethyl-hexanoate is particularly preferred because the resulting polymerized toner scarcely gives odor upon printing and barely causes environmental destruction by volatile components such as odor.

The amount of the polymerization initiator used is generally 0.001–3 wt. % based on the aqueous medium. If the amount of the polymerization initiator used is smaller than 0.001 wt. %, the polymerization rate becomes slow. On the other hand, any amount exceeding 3 wt. % is not economical.

A colorant is contained in the polymerized toner according to the present invention. The colorant is added to the core particles, and may also be contained in the shell as needed. Examples of the colorant include dyes and pigments such as carbon black, Nigrosine Base, aniline blue, Chalcoil Blue, chrome yellow, ultramarine blue, Orient Oil Red, Phthalocyanine Blue and Malachite Green oxalate; and magnetic powders such as cobalt, nickel, diiron trioxide, triiron tetraoxide, manganese iron oxide, zinc iron oxide and nickel iron oxide. The dye or pigment is generally used in a proportion of 0.1–20 parts by weight, preferably 1–10 parts by weight per 100 parts by weight of the polymerizable monomer for core, while the magnetic powder is generally used in a proportion of 1–100 parts by weight, preferably 5–50 parts by weight per 100 parts by weight of the polymerizable monomer for core.

In the present invention, as needed, various kinds of additives such as molecular weight modifiers and parting agents may be used by mixing them with the polymerizable monomer for core.

Examples of the molecular weight modifiers include mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is generally used in a proportion of 0.01–10 parts by weight, preferably 0.1–5 parts by weight per 100 part by weight of the polymerizable monomer for core.

Examples of the parting agents include low molecular weight polyolefins such as low molecular weight polyethylene, low molecular weight polypropylene and low molecular weight polybutylene; paraffin waxes; and higher fatty acid compounds such as higher fatty acids, and esters and salts thereof. The parting agent is generally used in a proportion of 0.1–20 parts by weight, preferably 1–10 parts by weight per 100 parts by weight of the polymerizable monomer for core.

Lubricants such as oleic acid and stearic acid; dispersion aids such as silane or titanium coupling agents; and the like may also be used with a view toward uniformly dispersing the colorant in the core particles. Such a lubricant or dispersion aid is generally used in a proportion of about 1/1000 to 1/1 based on the weight of the colorant.

The suspension polymerization for obtaining the core particles is continued until the conversion of the polymerizable monomer into a polymer reaches generally at least 80%, preferably at least 85%, more preferably at least 90%. If the conversion into the polymer is lower than 80%, a great amount of the polymerizable monomer for core remains unreacted, so that the surfaces of the resultant core particles are covered with a copolymer of the polymerizable monomer for core and a polymerizable monomer for shell even when the polymerizable monomer for shell is added to conduct polymerization. Therefore, a difference in Tg between the core particles and the shell becomes small, and so the shelf stability of the resulting polymerized toner tends to lower.

The polymerized toner according to the present invention can be obtained by subjecting the polymerizable monomer for shell to suspension polymerization in the presence of the core particles.

In the present invention, a monomer capable of forming a polymer having a glass transition temperature higher than that of the polymer component of the core particles is used as the polymerizable monomer for shell. A difference in Tg between the individual polymers is relative.

It is preferable to use, as the polymerizable monomer for shell, monomers capable of forming a polymer having a glass transition temperature of higher than 70° C., such as styrene and methyl methacrylate, either singly or in combination of two or more monomers thereof. When the glass transition temperature of the polymer obtained from the polymerizable monomer for core, or the polymer component of the core particles is far lower than 70° C., the polymerizable monomer for shell may be such that forms a polymer having a glass transition temperature of not higher than 70° C. However, the glass transition temperature of the polymer formed from the polymerizable monomer for shell must be preset so as to be higher than the glass transition temperature of the polymer component of the core particles.

In order to improve the shelf stability of the resulting polymerized toner, the glass transition temperature of the polymer formed from the polymerizable monomer for shell is preset within a range of generally 50–120° C., preferably 60–110° C., more preferably 70–105° C. If the glass transition temperature of the polymer formed from the polymerizable monomer for shell is too low, the shelf stability of the resulting polymerized toner may be lowered in some cases even though such a glass transition temperature is higher than that of the polymer component of the core particles.

A difference in glass transition temperature between the polymer component of the core particles and the polymer formed from the polymerizable monomer for shell is desirably controlled to generally at least 10° C., preferably at least 20° C., more preferably at least 30° C.

The polymerizable monomer for shell is preferably subjected to suspension polymerization in the presence of the core particles after it is formed into droplets smaller than the number average particle diameter of the core particles. If the droplet diameter of the droplets of the polymerizable monomer for shell is too great, the shelf stability of the resulting polymerized toner tends to lower. In order to form the polymerizable monomer for shell into fine droplets, a mixture of the polymerizable monomer for shell and an aqueous dispersion medium is subjected to a finely dispersing treatment by means of, for example, an ultrasonic emulsifier. The aqueous dispersion thus obtained is preferably added to an aqueous dispersion medium containing the core particles.

The polymerizable monomer for shell is not particularly limited by solubility in water at 20° C. However, when a polymerizable monomer for shell having a solubility in water of at least 0.1 wt. % at 20° C. is used, the monomer having a high solubility in water tends to rapidly migrate to the surfaces of the core particles, so that a polymerized toner having good shelf stability is easy to obtain.

On the other hand, when a polymerizable monomer for shell having a solubility in water of lower than 0.1 wt. % at 20° C. is used, its migration to the core particles becomes slow. Therefore, it is preferable to polymerize such a monomer after adding it in the form of fine droplets to the reaction system. When an organic solvent having a solubility in water of at least 5 wt. % at 20° C. is added to the reaction system in the case where the polymerizable monomer for shell having a solubility in water of lower than 0.1 wt. % at 20° C. is used, the polymerizable monomer for shell becomes easy to rapidly migrate to the core particles, so that a polimerized toner having good shelf stability is easy to obtain.

Examples of the polymerizable monomer for shell having a solubility in water of lower than 0.1 wt. % at 20° C. include styrene, butyl acrylate, 2-ethylhexyl acrylate, ethylene and propylene. Examples of the polymerizable monomer for shell having a solubility in water of at least 0.1 wt. % at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

Examples of the organic solvent suitably used in the case where the polymerizable monomer for shell having a solubility in water of lower than 0.1 wt. % at 20° C. is used include lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and amides such as dimethylformamide.

The organic solvent is added in such an amount that the solubility of the polymerizable monomer for shell in the dispersion medium (total amount of water and the organic solvent) is at least 0.1 wt. %. The amount of the organic solvent added varies according to the kind of the organic solvent, and the kind and amount of the polymerizable monomer for shell. However, it is generally 0.1–150 parts by weight, preferably 0.1–40 parts by weight, more preferably 0.1–30 parts by weight per 100 parts by weight of the aqueous dispersion medium. No particular limitation is imposed on the order of addition of the organic solvent and the polymerizable monomer for shell to the reaction system. In order to facilitate the migration of the polymerizable monomer for shell to the core particles to make easy to obtain a polymerized toner having good shelf stability, however, it is preferable to first add the organic solvent to the reaction system and then add the polymerizable monomer for shell.

When a monomer having a solubility in water of lower than 0.1 wt. % at 20° C. and a monomer having a solubility in water of at least 0.1 wt. % at 20° C. are used in combination, it is preferable to first add the monomer having a solubility in water of at least 0.1 wt. % at 20° C. to polymerize it, then add the organic solvent, and further add the monomer having a solubility in water of lower than 0.1 wt. % at 20° C. to polymerize it. According to this adding process, the Tg of the polymer obtained from the polymerizable monomer for shell, which is polymerized in the presence of the core particles for the purpose of controlling the fixing temperature of the resulting polymerized toner, and the amount of the monomer added can be suitably controlled.

The polymerizable monomer for shell may preferably be used in combination with a charge control agent. The charge control agent is used for improving the charge properties of the resulting polymerized toner. As the charge control agent, there may be used various kinds of charge control agents for positive charge and negative charge. Specific examples of the charge control agents include Nigrosine NO1 (product of Orient Chemical Industries Ltd.), Nigrosine EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.) and Bontron E-84 (product of Orient Chemical Industries Ltd.). The charge control agent is generally used in a proportion of 0.01–10 parts by weight, preferably 0.03–5 parts by weight per 100 parts by weight of the monomer composition.

Examples of a specific process for subjecting the polymerizable monomer for shell to suspension polymerization in the presence of the core particles include a process in which the polymerizable monomer for shell is added to the reaction system of the polymerization reaction which has been conducted for obtaining the core particles, thereby successively conducting polymerization, and a process in which the core particles obtained in a separate reaction system are charged, to which the polymerizable monomer for shell is added, thereby successively conducting polymerization.

The polymerizable monomer for shell may be added to the reaction system in one lot, or continuously or intermittently by means of a pump such as a plunger pump.

In order to make easy to obtain a polymerized toner of core-shell structure, it is preferable to add a water-soluble radical initiator at the time the polymerizable monomer for shell is added. It is considered that when the water-soluble radical initiator is added at the time the polymerizable monomer for shell is added, the water-soluble initiator enters in the vicinity of the outer surfaces of the core particles to which the polymerizable monomer for shell has migrated, so that a polymer layer (shell) is easy to form on the surfaces of the core particles.

Examples of the water-soluble radical initiator include persulfates such as potassium persulfate and ammonium persulfate; azo initiators such as 4,4-azobis(4-cyanovaleric acid), 2,2-azobis(2-amidinopropane) bihydrochloride and 2,2-azobis-2-methyl-N-1,1-bis-(hydroxymethyl)-2-hydroxyethylpropionamide; and combinations of an oil-soluble initiator such as cumene peroxide with a redox catalyst. The amount of the water-soluble initiator used is generally 0.001–1 wt. % based on the aqueous medium.

In the polymerized toner according to the present invention, a weight ratio of the polymerizable monomer for core to the polymerizable monomer for shell is generally 40/60 to 99.9/0.1, preferably 60/40 to 99.7/0.3, more preferably 90/10 to 99.5/0.5. If the proportion of the polymerizable monomer for shell is too low, the effect of improving the shelf stability becomes little. If the proportion is too high on the other hand, the effects of lowering the fixing temperature and improving the permeability through OHP become little.

The polymerized toner according to the present invention is composed of fine spherical particles sharp in particle diameter distribution in which the volume average particle diameter is generally 0.5–20 $\mu$m, preferably 3–15 $\mu$m, and the particle diameter distribution (volume average particle diameter/number average particle diameter) is generally at most 1.6, preferably at most 1.5.

The polymerized toner according to the present invention can be used as a developer as it is. However, it may also be used as a developer with various kinds of additives (external additives) such as a flowability improver added thereto. Examples of the additives include various kinds of inorganic particles and organic particles. Of these, silica particles and titanium oxide particles are preferred, with silica particles subjected to a hydrophobicity-imparting treatment being particularly preferred.

In order to apply the additives to the surface of the polymerized toner, the additives and the polymerized toner are generally charged into a mixer such as a Henschel mixer to mix them under stirring. These additives play a role of improving the flowability of the polymerized toner. These additives also act as an abrasive for the polymerized toner to prevent the occurrence of a toner-filming phenomenon on a photosensitive member.

When the polymerized toner according to the present invention is used, the fixing temperature can be lowered to 60–180° C., preferably 80–150° C. In addition, the polymerized toner does not aggregate during storage and is hence excellent in shelf stability.

An image forming apparatus, to which the polymerized toner according to the present invention is applied, is that including a photosensitive member, a means for charging the surface of the photosensitive member, a means for forming an electrostatic latent image on the surface of the photosensitive member, a means for receiving a toner (developer), a means for supplying the toner to develop the electrostatic latent image on the surface of the photosensitive member, thereby forming a toner image, and a means for transferring the toner image from the surface of the photosensitive member to a transfer medium. A specific example of such an image forming apparatus is illustrated in FIG. 1.

As illustrated in FIG. 1, in the image forming apparatus, a photosensitive drum 1 as the photosensitive member is installed rotatably in the direction of an arrow. The photosensitive drum 1 generally has a structure that a photoconductive layer is provided around a peripheral surface of an electroconductive support drum. The photoconductive layer is composed of, for example, an organic photosensitive member, selenium photosensitive member, zinc oxide photosensitive member or amorphous silicon photosensitive member.

Around the photosensitive drum 1, a charging roll 2 as a charging means, a laser beam irradiating device 3 as a latent image forming means, a developing roll 4 as a developing means, a transfer roll 10 as a transfer means, and optionally a cleaning device (not illustrated) are arranged along the circumferential direction of the drum.

The charging roll 2 bears an action that the surface of the photosensitive drum 1 is evenly charged either positively or negatively. Voltage is applied to the charging roll 2, and the charging roll 2 is brought into contact with the surface of the photosensitive drum 1, thereby charging the surface of the photosensitive drum 1. The charging roller 2 may be replaced by a discharging means by corona discharge.

The laser beam irradiating device 3 bears an action that light corresponding to image signals is irradiated on the surface of the photosensitive drum 1 to expose the surface of the photosensitive drum 1 evenly charged to the light on the predetermined pattern, thereby forming an electrostatic latent image on the exposed portion of the drum (in the case of reversal development) or forming an electrostatic latent image on the unexposed portion of the drum (in the case of normal development). An example of other latent image forming means includes that composed of an LED array and an optical system.

The developing roll 4 bears an action that a toner is applied to the electrostatic latent image formed on the surface of the photosensitive drum 1. Bias voltage is applied between the development roller 4 and the photosensitive drum 1 in such a manner that the toner is caused to adhere only to a light-exposed portion of the photosensitive drum 1 in reversal development, or only to a light-unexposed portion of the photosensitive drum 1 in normal development.

In a casing 9 for receiving the toner 7, the developing roll 4 and a feed roll 6 are arranged. The developing roll 4 is arranged in close vicinity to the photosensitive drum 1 in such a manner that a part thereof comes into contact with the photosensitive drum 1, and is rotated in a direction B opposite to the rotating direction of the photosensitive drum 1. The feed roll 6 is rotated in contact with and in the same direction as the developing roll 4 to supply the toner 7 to the outer periphery of the developing roll 4. An agitating means (agitating blade) 8 for agitating the toner is installed in the casing 9.

A blade 5 for developing roll as a layer thickness regulating means is arranged at a position between the contact point with the feed roll 6 and the contact point with the photosensitive drum 1 on the periphery of the developing roll 4. The blade 5 is composed of conductive rubber or stainless steel, and voltage of |200 V| to |600 V| is applied to the blade to charge the toner. Therefore, the resistivity of the blade 5 is preferably $10^6$ Ωcm or lower.

The polymerized toner 7 according to the present invention is contained in the casing 9 of the image forming apparatus. The polymerized toner 7 may contain additives such as a flowability improver. Since the polymerized toner according to the present invention has a core-shell structure, and the shell of the surface layer is formed of a polymer having a relatively high glass transition temperature, the stickiness of the surface is reduced, and so the polymerized toner is prevented from aggregating during storage in the casing 9. In addition, since the particle diameter distribution of the polymerized toner according to the present invention is relatively sharp, the toner layer formed on the developing roll 4 can be made a substantially single layer by the layer thickness regulating means 5, thereby forming reproducible images of good quality.

The transfer roll 10 serves to transfer the toner image formed on the surface of the photosensitive drum 1 by the developing roll 4 to a transfer medium 11. Examples of the transfer medium 1 include paper and resin sheets such as OHP sheets. As transferring means, may be mentioned a corona discharge device and a transfer belt in addition to the transfer roll 10.

The toner image transferred to the transfer medium 11 is fixed to the transfer medium by a fixing means. The fixing means is generally composed of a heating means and a press-bonding means. More specifically, the fixing means is generally composed of the combination of a heating roll (fixing roll) 12 and a press roll 13. The transfer medium 11, to which the toner image has been transferred, is passed through between the heating roll 12 and the press roll 13 to melt the toner, and at the same time press-bond it to the transfer medium 11, thereby fixing the toner image.

In the image forming apparatus of the present invention, the polymerized toner according to the present invention is used as a toner. Therefore, the toner is easily melted even when the heating temperature by the heating means is low, and is fixed to the transfer medium in a flattened state by slightly pressing it by the press-bonding means, so that high-speed printing or copying is feasible. Further, the toner image fixed to an OHP sheet is excellent in permeability through OHP.

The cleaning device serves to clean off the toner remaining on the surface of the photosensitive drum 1 without transferring and is composed of, for example, a cleaning blade or the like. This cleaning device is not always required in the case where a system that cleaning is conducted at the same time as development is adopted.

In the image forming process according to the present invention, which comprises the steps of applying a toner to the surface of a photosensitive member, on which an electrostatic latent image has been formed, to make the latent image visible, and then transferring the visible image to a transfer medium, the polymerized toner according to the present invention is used as the toner.

ADVANTAGE OF THE INVENTION

According to the present invention, there are provided polymerized toners having a low fixing temperature and uniformly melting ability, and moreover excellent shelf stability, and a production process thereof. The use of the polymerized toner according to the present invention permits high-speed and full-color copying and printing, and energy saving. The polymerized toner according to the present invention can form a toner image which exhibits excellent permeability through OHP when conducting printing on an OHP sheet with the toner and fixing thereto. According to the present invention, there are provided an image forming process making use of the polymerized toner having such excellent various properties, and an image forming apparatus in which said polymerized toner is received.

EMBODIMENTS OF THE INVENTION

The present invention will hereinafter be described more specifically by the following examples and comparative examples. However, the present invention is not limited to these examples only. Incidentally, all designations of "part" or "parts" and "%" as will be used in the following examples mean part or parts by weight and wt. % unless expressly noted.

Physical properties in the following examples and comparative examples were measured in accordance with the following respective methods.

(1) Particle Diameter:

The volume average particle diameter (dv) and particle diameter distribution, i.e., a ratio (dv/dp) of volume average particle diameter to number average particle diameter (dp) of particles were measured by means of a Coulter counter (manufactured by Coulter Co.). The measurement by the Coulter counter was conducted under the following conditions:

aperture diameter: 100 $\mu$m;

medium: Isothone II, concentration: 15%; and number of particles measured: 50,000 particles.

The thickness of the shell in each toner sample was calculated out from the volume average particle diameter of its core particles and the amount of a polymerizable monomer for shell used.

(2) Volume resistivity of toner:

The volume resistivity of each toner sample was measured by means of a dielectric loss measuring device (TRS-10 Model, trade name; manufactured by Ando Electric Co., Ltd.) under conditions of a temperature of 30° C. and a frequency of 1 kHz.

(3) Fixing temperature of toner:

A commercially available printer of a non-magnetic one-component development system was modified in such a manner that the temperature of a fixing roll can be varied. This modified printer was used to form an image with each toner sample, thereby evaluating the image. A temperature at which a fixing rate of the toner amounted to 80% was defined as a fixing temperature. The fixing test was conducted by varying the temperature of the fixing roll in the printer to determine the fixing rate at each temperature, thereby finding a relationship between the temperature and the fixing rate.

The fixing rate was calculated from the ratio of image densities before and after a peeling operation of a pressure-sensitive adhesive tape, wherein a pressure-sensitive adhesive tape was applied to a black solid area of a test paper sheet, on which printing had been made by the modified printer, to cause the tape to adhere to the sheet by pressing the tape under a fixed pressure, and the tape was then peeled from the sheet. Supposing that the image density before the peeling of the adhesive tape is $ID_{before}$, and the image density after the peeling of the adhesive tape is $ID_{after}$, the fixing rate is determined by the following equation:

$$\text{Fixing rate}(\%)=(ID_{after}/ID_{before})\times 100$$

In this test, the black solid area means an area controlled in such a manner that the toner is caused to adhere to all dots within this area. The peeling operation of the pressure-sensitive adhesive tape is a series of operation that a pressure-sensitive adhesive tape (Scotch Mending Tape 810–3–18, trade name; product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by Macbeth Co.

(4) Shelf stability of toner:

The evaluation of shelf stability was conducted by placing each toner sample in a closed container to seal it, sinking the container into a constant-temperature water bath controlled to 50° C. and then taking the container out of the water bath after a predetermined period of time went on, thereby measuring the weight of toner aggregated. The sample toner taken out of the container was transferred to a 42-mesh screen so as not to destroy the structure thereof as much as possible, and the screen was vibrated for 30 seconds with an intensity of 4.5 by means of a powder measuring device, REOSTAT (manufactured by Hosokawa Micron Corporation). Thereafter, the weight of the toner remaining on the screen was measured to regard it as the weight of the toner aggregated. The aggregation rate (wt. %) of the toner was calculated out from this weight of the aggregated toner and the weight of the sample.

The shelf stability of the toner sample was valuated by 4 ranks in accordance with the following tandard:

◎: aggregation rate was lower than 5 wt. %;

○: aggregation rate was not lower than 5 wt. % but low than 10 wt. %;

Δ: aggregation rate was not lower than 10 wt. % but low than 50 wt. %; and

X: aggregation rate was not lower than 50 wt. %.

(5) Permeability through OHP:

The temperature of the fixing roll in the modified printer described above was preset to 170° C. to conduct printing on a commercially available OHP sheet (Transparency, product of Uchida Yoko Co., Ltd.), thereby evaluating the permeability through OHP of each toner sample. Whether the printed image permeated through the OHP sheet or not was visually observed, thereby evaluating its permeability.

EXAMPLE 1

Stirred and mixed at 6,000 rpm in a homomixer (TK type, manufactured by Tokushu Kika Kogyo Co., Ltd.) capable of mixing with high shearing force were a polymerizable monomer (calculated Tg of the resulting copolymer: 35° C.) for core composed of 70 parts of styrene and 30 parts of n-butyl acrylate, 5 parts of carbon black (Printex 150T, trade name; product of Degussa AG), 1 part of a charge control agent (Spiron Black TRH, trade name; product of Hodogaya Chemical Co., Ltd.), 0.3 parts of divinylbenzene, 0.5 parts of a polymethacrylic ester macromonomer (AA6, trade name; Tg: 94° C.; product of Toagosei Chemical Industry Co., Ltd.), and 2 parts of t-butyl peroxy-2-ethylhexanoate, thereby obtaining a liquid mixture for core uniformly dispersed.

On one hand, 5 parts of methyl methacrylate (calculated Tg of the resulting polymer: 105° C.), 100 parts of water and 0.01 parts of a charge control agent (Bontron E-84, trade name; product of Orient Chemical Industries, Ltd.) were subjected to a finely dispersing treatment by an ultrasonic emulsifier. thereby obtaining an aqueous dispersion of a polymerizable monomer for shell. The droplet diameter of droplets of the polymerizable monomer for shell was found to be 1.6 μm in terms of $D_{90}$ as determined by means of a microtrack particle diameter distribution measuring device by adding the droplets at a concentration of 3% to a 1% aqueous solution of sodium hexametaphosphate.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metal salt) dissolved in 250 parts of ion-exchanged water to prepare a dispersion of colloid (colloid of hardly water-soluble metal hydroxide) of magnesium hydroxide. The particle diameter distribution of the colloid formed was measured by means of a microtrack particle diameter distribution measuring device (manufactured by Nikkiso Co., Ltd.) and found to be 0.38 μm in terms of $D_{50}$ (50% cumulative value of number particle diameter distribution) and 0.82 μm in terms of $D_{90}$ (90% cumulative value of number particle diameter distribution). The measurement by means of the microtrack particle diameter distribution measuring device was performed under the following conditions:

measuring range: 0.12–704 μm;

measuring time: 30 seconds; and medium: ion-exchanged water.

The liquid mixture containing the polymerizable monomer for core was then poured into the colloidal dispersion of magnesium hydroxide obtained above, and the resultant mixture was stirred at 8,000 rpm under high shearing force by means of the TK type homomixer, thereby forming droplets. The thus-prepared aqueous dispersion containing droplets of the liquid mixture for core was charged into a reactor equipped with an agitating blade to initiate a polymerization reaction at 65° C. At the time a conversion into a polymer reached almost 100%, the aqueous dispersion of the polymerizable monomer for shell prepared above and 1 part of a 1% aqueous solution of potassium persulfate were added to continue the reaction for 5 hours. Thereafter, the reaction was stopped to obtain an aqueous dispersion containing polymer particles of core-shell structure.

The volume average particle diameter (dv) of core particles measured by taking out them just before the polymerizable monomer for shell was added was 5.70 μm, and a ratio of the volume average particle diameter (dv) to the number average particle diameter (dp) thereof was 1.32 The resultant polymer particles had an r/rs ratio of 1.12 and contained 3% of toluene-insoluble matter.

While stirring the aqueous dispersion of the polymer particles obtained above, the pH of the system was adjusted to 4 or lower with sulfuric acid to conduct acid washing (25° C., 10 minutes). After water was separated by filtration from the dispersion, 500 parts of ion-exchanged water were newly added to form a slurry again, thereby conducting water washing. Thereafter, dehydration and water washing were conducted again repeatedly several times, followed by collection of solid matter by filtration. The solid matter was then dried at 50° C. for 24 hours by a dryer to obtain polymer particles (polymerized toner).

Added to 100 parts of the polymerized toner of core-shell structure obtained above were 0.3 parts of colloidal silica (R-972, trade name: product of Nippon Aerosil Co., Ltd.) subjected to a hydrophobicity-imparting treatment, and they were mixed by means of a Henschel mixer to prepare a non-magnetic one-component developer (may referred to as a developer or toner merely). The volume resistivity of the developer thus obtained was measured and found to be 11.25 logΩ·cm. The developer thus obtained was used to measure its fixing temperature, and was found to be 130° C. The shelf stability of the developer was very good (rank: ◎). The results are shown in Table 1. Besides, the evaluation of image revealed that an image high in image density, free of fog and irregularities, and extremely good in resolution was obtained.

EXAMPLE 2

A polymerized toner and a developer were obtained in the same manner as in Example 1 except that the amount of the macromonomer in Example 1 was changed to 3 parts. The results are shown in Table 1. The evaluation of image revealed that an image high in image density, free of fog and irregularities, and extremely good in resolution was obtained.

EXAMPLE 3

A polymerized toner and a developer were obtained in the same manner as in Example 1 except that the macromonomer in Example 1 was changed to an acrylate type macromonomer (AA2, trade name; Tg: about 90° C.; product of Toagosei Chemical Industry Co., Ltd.). The results are shown in Table 1.

EXAMPLE 4

A polymerized toner and a developer were obtained in the same manner as in Example 1 except that 5 parts of methyl methacrylate as the polymerizable monomer for shell in Example 1 were changed to 1.8 parts of methyl methacrylate and 0.2 parts of butyl acrylate. The evaluation results are shown in Table 1.

EXAMPLE 5

A polymerized toner and a developer were obtained in the same manner as in Example 1 except that 2 parts of styrene were used in place of 5 parts of methyl methacrylate used as the polymerizable monomer for shell in Example 1, and 20 parts of methanol were added just before the polymerizable monomer for shell was added.

The evaluation results are shown in Table 1.

TABLE 1

| | Example | | | | |
|---|---|---|---|---|---|
| | 1 | 2 | 3 | 4 | 5 |
| Core particles | | | | | |
| dv [μm] | 5.70 | 5.91 | 6.17 | 5.70 | 5.70 |
| dv/dp | 1.32 | 1.33 | 1.30 | 1.31 | 1.32 |
| Polymerized toner | | | | | |
| Thickness of shell [μm] | 0.05 | 0.05 | 0.05 | 0.02 | 0.02 |
| rl/rs | 1.12 | 1.13 | 1.12 | 1.13 | 1.12 |
| Toluene-insoluble matter [%] | 3 | 6 | 4 | 0 | 2 |
| Evaluation of toner | | | | | |
| Volume resistivity [logΩcm] | 11.25 | 11.23 | 11.21 | 11.42 | 11.27 |
| Fixing temperature [° C.] | 130 | 140 | 120 | 125 | 130 |
| Shelf stability | ⊙ | ⊙ | ⊙ | ⊙ | ⊙ |

EXAMPLE 6

A polymerized toner and a developer were obtained in the same manner as in Example 1 except that 2,2-azobis-isobutyronitrile was used in place of t-butyl peroxy-2-ethylhexanoate used in the liquid mixture for core in Example 1, and the reaction temperature was changed to 90° C. The evaluation results are shown in Table 2. When this developer was used to conduct fixing, slight odor was given off.

EXAMPLE 7

A polymerized toner and a developer were obtained in the same manner as in Example 1 except that the polymerizable monomer for shell was added without conducting the treatment by means of the ultrasonic emulsifier in Example 1. The evaluation results are shown in Table 2.

EXAMPLE 8

A polymerized toner and a developer were obtained in the same manner as in Example 1 except that butyl acrylate used as the polymerizable monomer for core in Example 1 was changed to 2-ethylhexyl acrylate. The evaluation results are shown in Table 2.

COMPARATIVE EXAMPLE 1

A polymerized toner and a developer were obtained in the same manner as in Example 1 except that the amount of the macromonomer used in Example 1 was changed to 0 part (the macromonomer was not used), and 5 parts of methyl methacrylate used as the polymerizable monomer for shell were changed to 12 parts of methyl methacrylate. The evaluation results are shown in Table 2.

COMPARATIVE EXAMPLE 2

A polymerized toner and a developer were obtained in the same manner as in Example 1 except that the polymerizable monomer for shell in Example 1 was not added, Aerosil 200 (trade name, product of Nippon Aerosil Co., Ltd.) was used In place of the colloidal dispersion of magnesium hydroxide, and alkali washing with an aqueous solution of sodium hydroxide was conducted in place of the acid washing. The evaluation results are shown in Table 2.

TABLE 2

| | Example | | | Comp. Ex. | |
|---|---|---|---|---|---|
| | 6 | 7 | 8 | 1 | 2 |
| Core particles | | | | | |
| dv [μm] | 5.83 | 5.70 | 4.97 | 6.87 | 7.57 |
| dv/dp | 1.38 | 1.34 | 1.31 | 1.33 | 1.63 |
| Polymerized toner | | | | | |
| Thickness of shell [μm] | 0.95 | 0.05 | 0.05 | 0.12 | — |
| rl/rs | 1.13 | 1.13 | 1.12 | 1.13 | 1.11 |
| Toluene-insoluble matter [%] | 3 | 2 | 0 | 5 | 2 |
| Evaluation of toner | | | | | |
| Volume resistivity [logΩcm] | 11.28 | 11.26 | 11.25 | 11.28 | 11.45 |
| Fixing temperature [° C.] | 135 | 125 | 120 | 125 | 120 |
| Shelf stability | ⊙ | ⊙ | ⊙ | Δ | X |

EXAMPLE 9

A polymerized toner and a developer were obtained in the same manner as in Example 1 except that 5 parts of Phthalocyanine Blue (GNX, trade name; product of Sumitomo Chemical Co., Ltd.) were used in place of 5 parts of carbon black in Example 1. The evaluation results are shown in Table 3.

COMPARATIVE EXAMPLE 3

A polymerized toner and a developer were obtained in the same manner as in Example 9 except that the amount of the macromonomer used in Example 9 was changed to 0 part (the macromonomer was not used), and 5 parts of methyl methacrylate used as the polymerizable monomer for shell were changed to 12 parts of methyl methacrylate. The evaluation results are shown in Table 3.

COMPARATIVE EXAMPLE 4

A polymerized toner and a developer were obtained in the same manner as in Example 9 except that the amount of the macromonomer used in Example 9 was changed to 0 part (the macromonomer was not used), 70 parts of styrene and 30 parts of n-butyl acrylate used as the polymerizable monomers for core were changed to 85 parts and 15 parts, respectively, no polymerizable monomer for shell was added, Aerosil 100 (trade name, product of Nippon Aerosil Co., Ltd.) was used in place of the colloidal dispersion of magnesium hydroxide, and alkali washing was conducted in place of the acid washing. The valuation results are shown in Table 3.

TABLE 3

| | Ex. | Comp. Ex. | |
|---|---|---|---|
| | 9 | 3 | 4 |
| Core particles | | | |
| dv [μm] | 5.73 | 5.87 | 7.57 |
| dv/dp | 1.32 | 1.33 | 1.66 |
| Polymerized toner | | | |
| Thickness of shell [μm] | 0.05 | 0.12 | — |
| rl/rs | 1.13 | 1.13 | 1.18 |
| Toluene-insoluble matter [%] | 3 | 12 | 14 |
| Evaluation of toner | | | |
| Volume resistivity [logΩcm] | 11.25 | 11.56 | 11.77 |
| Fixing temperature [° C.] | 130 | 135 | 150 |
| Shelf stability | ⊚ | Δ | ⊚ |
| Permeability through OHP | Permeable | Semi-permeable | Im-permeable |

We claim:

1. Polymerized toner of core-shell structure, comprising core particles composed of colored polymer particles having a volume average particle diameter (dv) of 0.5–20 μm and a ratio (dv/dp) of the volume average particle diameter (dv) to a number average particle diameter (dp) of at most 1.7, and shell which is formed of a polymer layer having an average film thickness of 0.001–0.1 μm and covers each of the core particles, wherein a glass transition temperature of a polymer component making up the core particles is 10–60° C.

2. The polymerized toner according to claim 1, wherein the core particles are colored polymer particles obtained by subjecting a polymerizable monomer composition containing at least a colorant and a polymerizable monomer for core to suspension polymerization in the presence of a macromonomer.

3. The polymerized toner according to claim 2, wherein the polymerizable monomer composition further contains a crosslinking monomer.

4. The polymerized toner according to claim 1, wherein the shell is a polymer layer formed by subjecting a polymerizable monomer for shell to suspension polymerization in the presence of the core particles.

5. The polymerized toner according to claim 4, wherein the shell is a polymer layer formed by subjecting a polymerizable monomer for shell to suspension polymerization together with a charge control agent in the presence of the core particles.

6. The polymerized toner according to claim 1, wherein the glass transition temperature of a polymer component making up the shell is higher than that of a polymer component making up the core particles.

7. The polymerized toner according to claim 1, wherein the polymerized toner has a ratio (rl/rs) of the length (rl) to the breadth (rs) within a range of 1–1.2.

8. The polymerized toner according to claim 1, wherein the polymerized toner contains toluene-insoluble matter in an amount of at most 50 wt. %.

9. An image forming apparatus, comprising a photosensitive member, a means for charging the surface of the photosensitive member, a means for forming an electrostatic latent image on the surface of the photosensitive member, a means for receiving a toner, a means for supplying the toner to develop the electrostatic latent image on the surface of the photosensitive member, thereby forming a toner image, and a means for transferring the toner image from the surface of the photosensitive member to a transfer medium, wherein the means for receiving the toner contains a polymerized toner of core-shell structure, comprising core particles composed of colored polymer particles having a volume average particle diameter (dv) of 0.5–20 μm and a ratio (dv/dp) of the volume average particle diameter (dv) to a number average particle diameter (dp) of at most 1.7, and shell which is formed of a polymer layer having an average film thickness of 0.001–0.1 μm and covers each of the core particles, wherein a glass transition temperature of a polymer component making up the core particles is 10–60° C.

* * * * *